US005590761A

United States Patent [19]

Owen

[11] Patent Number: 5,590,761

[45] Date of Patent: Jan. 7, 1997

[54] COIN DISPLAY HOLDER

[76] Inventor: David B. Owen, 11513 River Dr. East, Carmel, Ind. 46033

[21] Appl. No.: 640,541

[22] Filed: May 2, 1996

[51] Int. Cl.[6] ..... A45C 11/24

[52] U.S. Cl. ..... 206/0.82; 206/776

[58] Field of Search ..... 206/0.8, 0.81, 206/0.82, 0.83, 0.84, 775, 776, 782

[56] References Cited

U.S. PATENT DOCUMENTS

| | | | |
|---|---|---|---|
| 3,028,949 | 4/1962 | Sohosky | 206/0.83 |
| 3,057,459 | 10/1962 | Burdick | 206/0.83 |
| 3,069,001 | 12/1962 | Burdick | 206/0.83 |
| 3,837,475 | 9/1974 | Bolanz | 206/0.8 |
| 4,402,399 | 9/1983 | Friess | 206/0.83 |

*Primary Examiner*—Jacob K. Ackun
*Attorney, Agent, or Firm*—Robert A. Spray, Patent Atty.

[57] ABSTRACT

A hard case coin display holder advantageously universal to coin size and shape, especially useful for ancient coins and Spanish pieces-of-eight which are always of irregular size and shape, while holding the coin attractively spatially centered, by at least two flexible transparent spring tension arms, within the protective confines of a quickly and easily assemblable and disassemblable see-through hard case. The present invention leaves much more of the irregularly shaped coin visible in the display than that achieved by opaque resilient rubberlike holed cores, which are the only present universal coin display interiors.

6 Claims, 4 Drawing Sheets

COIN DISPLAY HOLDER

FIELD AND BACKGROUND OF THE INVENTION

The present invention relates to numismatics' supplies and more particularly to holders for protecting and displaying coins in coin collections.

Still more particularly, the present invention relates to a holder by which irregularly shaped coins such as Spanish pieces-of-eight can be displayed attractively and advantageously.

PROBLEMS INHERENT AS TO THE DISPLAYING OF IRREGULARLY SHAPED COINS

A long-known problem in the numismatics field is that a typical coin collector has a challenge in protectively and attractively displaying his or her coins, yet a protective and attractive display is considered quite necessary in order to preserve and enjoy his or her collection.

Making the collectors' task difficult, especially to ancient coins, is the fact that the ancient coins are always of irregular size and shape, and this limits the type of holders which can accommodate them. The limitations, at present, are to soft, pliable holders which can not inherently attractively center the coin in the holder. No matter how valuable the ancient coin, it is likely to be clumsily displayed in the soft, pliable coin holders which, in the numismatics field, are commonly referred to as "flips," as further described herein.

Yet with regular sized coins of relatively modern manufacture, there are a wide variety of attractive hard case coin holders available; however, these hard case coin holders which protectively and attractively center the modern coins are not available for ancient coins.

There have existed hard case coin holders in which there is employed a rubberlike core insert with cutouts which allow the core to be dissected into various sizes of abutted rings starting from the center, to accomodate various sized coins, but this arrangement has performance and convenience disadvantages, as further described herein.

SUMMARY OF THE PRESENT INVENTION

The invention is a coin display holder in the nature of a hard case having the capability of holding ancient, irregularly shaped, hand-forged types of coins and modern error coins such as off-center strikes.

In several variations, hard cases already exist for holding modern, regular shaped coins usually manufactured by the coining process. And there has existed a type of hard case coin holder with an opaque resilient rubberlike holed insert which could be used to hold ancient coins, but none of these hard case variations successfully hold and properly fully visibly display an irregularly shaped coin.

Existing hard cases for coined type of coins, by several mechanical means, offer a cylindrical interior cavity of a standard size to fit a standard size coin. In contrast, the present invention provides a specialized interior cavity, utilizing two or more transparent spring tension arms, substantially conjoined to the coin case, with the arms extending inward of the coin case into the cavity. The arms are in a relatively unstressed condition with their inward ends close to the center of the cavity, and by elastic deformation, are capable of clamping the coin in a fully centered fashion via grooves in the outward ends of the spring tension arms, without any visual blockage to the coin.

The grooves in the outward ends of the spring tension arms essentially cup the coin and hold it substantially spatially centered in position within the cavity of the coin holder. Whether two, or three, or more spring tension arms were utilized, there would preferrably be at least six potential contact points provided between the grooves of the arms and the coin, to hold it in position with respect to its general plane, and with respect to its position perpendicular to its general plane. If only two spring tension arms, instead of at least three, were utilized, then the outward ends of the arms would have to be bifurcated to facilitate a positive clamping mode.

Summarized, the present invention is a coin holder for the purpose of displaying ancient coins and Spanish pieces-of-eight easily and quickly without any special modifications.

PRIOR ART CAPABILITY AND MOTIVATIONS, AS HELPING TO SHOW PATENTABILITY HERE

In hindsight consideration of the present invention to determine its inventive and novel nature, it is not only conceded but emphasized that the prior art had details usable in this invention, but only if the prior art had had the guidance of the present concepts of the present invention, details of both capability and motivation.

That is, it is emphasized that the prior art had or knew several particulars which individually and accumulatively show the non-obviousness of this combination invention. E. g., a. The prior art has long had cardboard, plastic, rubber or other containers of many shapes and sizes;

b. The prior art knew the advantages of economical production of containers;

c. The prior art has long known that easy assembly of plastic or other components was a useful and needed characteristic of various items and of containers in particular;

d. The prior art has long known that plastics can be economically molded into various parts;

e. The prior art has had the knowledge of the typical desire of coin collectors to use holders for displaying all of the coins in his or her collection, including ancient coins;

f. The prior art has been aware of the problems inherent as to the protective display of ancient coins, particularly in consideration of their non-symmetry and other irregularities of size, shape and thickness;

g. The prior art of the numismatics industry has surely supposed or known that many customers have been and surely would be quite willing to purchase coin display cases which would be protectively attractive, providing not only an easy and secure centering of the coin in the mount, but also provide for easy and convenient opening of the mount for physically inspecting the coin;

h. The relative ease of tooling and overall simplicity of coin display cases have surely given their manufacturers ample incentive to have made modifications for commercial competitiveness in a competitive industry;

i. The prior art has always had sufficient skill to make many types of containers, movable-parts products and various articles having a variety of parts, more than ample skill to have achieved the prior invention, but only if the concepts and their combinations had been conceived;

j. Substantially all of the operational characteristics and advantages of details of the present invention, when considered separately from the present invention's details and non-technical accomplishment of the details, are within the skill of persons of various arts, but only when considered away from the integrated and novel combination of concepts which by their cooperative combination achieves this advantageous invention;

k. The details of the present invention, when considered solely from the standpoint of construction, are relatively simple, and the matter of simplicity of construction has long been recognized as indicative of inventive creativity; and l. Similarly, and a long-recognized indication of inventiveness of a novel combination, is the realistic principle that a person of ordinary skill in the art, as illustrated with respect to the claimed combination as differing in the stated respects from the prior art both as to construction and concept, is that the person of ordinary skill in the art is presumed to be one who thinks along the line of conventional wisdom in the art and is not one who undertakes to innovate.

Accordingly, although the prior art has had capability and motivation, amply sufficient to presumably give incentive to the development of coin display cases according to the present invention, the fact remains that the present invention awaited the creativity and inventive discovery of the present inventor. In spite of ample motivation and capability shown by the illustrations herein, the prior art did not suggest this invention.

PRIOR ART AS PARTICULAR INSTANCES OF FAILURE TO PROVIDE ADVANTAGEOUS DISPLAY CASES FOR ANCIENT COINS

In view of the inherent difficulties which attend the display of ancient coins in a mounting device, it is not difficult to realize that the prior art has failed in this regard, even though coin collecting is a widespread hobby and the numismatics industry is quite commercial and competitive. Further, coin collectors surely include a multitude of wealthy persons, at least of sufficient wealth that the prices of coin display cases would seem almost negligible in comparison to the prices to be paid for some ancient coins.

The consideration of a nature of the present inventive concepts will be helped by a summarized consideration of the prior art.

Since the time that coins were first invented by the Ionians in about 700 B.C., they have been hammer-forged by hand out of metal blanks that were not always round. Each coin differed in size and shape because the dies, which were engraved by hand, wore down quickly, the hammering was not even, and the blanks were also not uniformly thick. For the first 2200 years, coins were made in this way until about 1500 A.D. when the first coinage machinery came into use in Italy and spread slowly through Europe. These newer coins were, and still are, manufactured by the coining process. The hand forged type of coins include all ancient and medieval coins, and pieces-of-eight such as the ones found by Mel Fisher in the wreckage of the Spanish treasure galleon *Nuestra Senora de Atocha* which went down in 1622 in a hurricane off the coast of the Florida Keys.

It is mainly the hand forged type of coin for display in a safe and attractive manner which is the object of this invention. The hand forged type of coin, due to the nature of its making, varies from the symmetric and uniform coined type in that the hand forged type is always of an irregular size and shape, and the coined type is nearly always of a standard size and uniform shape.

There are currently no hard cases available which successfully hold the inherently odd-shaped ancient coins, as is described further herein, and this unavailability of a successful hard case display exists in spite of the usually considered advantages of a hard case display for regular-shaped modern coins. The advantages of a hard case for any coin is that it offers maximum protection for the coin and attractive centering of the integrated coin in the holder.

Hand forged coins, as mentioned above, are of an irregular size and shape without a uniform diameter or thickness, and thus are limited to the types of coin holders that can be used to contain them.

The holders now used most widely for ancient coins are twin pocket flips with a label insert. These are transparent, pliable, welded plastic sheets which form a pair of pockets, joined, and folded together into an approximately 2" by 2" U-shaped holder, with the openings of the pockets in the interior of, and abutting, the fold. One pocket is for the ancient coin, and the other pocket is for a paper label. The collectors of ancient coins are relegated to use these soft plastic devices despite the fact that they offer no coin centering capability and despite the fact that the ancient coin displayed therein could easily slither out of their pockets when handling the holder.

Flips and other types of coin holders, such as paper and plastic staple-together units not of a hard case nature, and hard case holders for regular sized coins, are available from Brooklyn Gallery Coins and Stamps, Inc., 8725 4th Avenue, P.O. Box 090-146, Brooklyn, N.Y. 11209-0003, (718) 745-5701.

If the existing hard cases are attempted to be used for holding an ancient coin, the coin would either rattle around in the internal display cavity or be too large to fit in the cavity at all.

As to prior art coin holders which could be said to be of a hard case construction with capability to mount irregularly shaped coins in a centered fashion, there have existed assemblies in which there is employed an opaque resilient rubberlike holed core insert, which indeed gives a range of adaptability to irregularly shaped coins. To enhance the adaptability to a range of sizes and shapes of coins, the rubberlike core inserts have cutouts which allow the core to be dissected into various sizes of abutted rings starting from the center.

However there exists a disadvantageous side effect, i.e., that the resilient rubberlike core, which has no transparency, encroaches upon the edges of the ancient coin and the outer areas of the faces of the ancient coin. This disadvantage occurs because not only does the core have to merely contain the edges of the ancient coin, but it also, in the case of an ancient coin, must clamp it so that it doesn't rattle against the inner faces of the outer frame pieces of the hard case holder. Moreover, in clamping the ancient coin, the resilient rubberlike core covers up too much of the periphery of the coin to be considered to be a proper mount which at least makes visible the entire faces of the coin if not also the edges.

Another disadvantage with the prior art arrangement is that the removed rubberlike rings become separated from the coin holder, and may not later be available for another size coin to be displayed.

As to any prior art hard case coin holders with specialized interior coin nests, 1.) Richard Burdick, COIN HOLDERS, U.S. Pat. No. 3,199,666, Aug. 10, 1965: the specialized interior coin nest is not flexibly adaptive to coins of irregular size and shape.

2.) Raymond E. Deese, COIN DISPLAY, U.S. Pat. No. 4,043,477, Aug. 23, 1977: the specialized interior coin nest is designed for uniformly sized coins, but if its coin nest were used for coins of irregular size and shape, its coin nest would have the disadvantages paralleling the insert described above, as to a resilient rubberlike holed core insert.

3.) Bela G. Szabo and Dean J. Hirschfield, PLASTIC CONTAINERS FOR SMALL VALUABLE ARTICLES, U.S. Pat. No. 4,320,831, Mar. 23, 1982: the specialized interior nest, if used for coins of irregular size and shape, would likewise have the disadvantages paralleling the insert described above, as to a resilient rubberlike holed core insert.

4.) Robert F. Grant, ARTICLE DISPLAY AND HOLDER APPARATUS, U.S. Pat. No. 4,425,997, Jan. 17, 1984: its specialized interior nest uses a pair of flexible transparent sheets which are compressed between a two-piece storage device to enhance airtightness as described in the paragraph of the parent's Column 2, Line 10. This adaptation, in and of itself, in addition to being designed for a different purpose, could not hold coins of irregular size and shape up to nearly the limits of the casing's display area. In particular, the pair of flexible transparent sheets which are compressed between the two-piece storage device would prevent the capability of displaying coins of a size and shape up to nearly the limits of the casing's display area unless some other design features were employed which would be beyond the scope of the Grant invention.

5.) J. Malcolm Dunn, DISPLAY PACKAGES, U.S. Pat. No. 4,466,534, Aug. 21, 1984: if a coin were to be displayed in this display package, it would exhibit disadvantages paralleling those of the Grant invention.

6.) Steven H. Mayer and David Hall, TAMPERPROOF COIN CASE, U.S. Pat. No. 5,042,650, Aug. 27, 1991: the specialized interior coin nest is designed for uniformly sized coins, but if its coin nest were used for coins of irregular size and shape, its coin nest would, as mentioned, have the disadvantages paralleling the insert described above as to a resilient rubberlike holed core insert.

SUMMARY OF THE PRIOR ART'S LACK OF SUGGESTIONS OF THE CONCEPTS OF THE INVENTION COMBINATION

In spite of all such factors of the prior art, the problem here solved awaited this inventor's present creativity. More particularly as to the novelty here of the invention as considered as a whole, the resume of the prior art uses and needs helps to show its contrast to the present concepts, and emphasizes the advantages, novelty, and the inventive significance of the present concepts as are here shown, particularly as to utility, attractiveness and convenience of use as detailed herein.

Moreover, prior art articles known to this inventor which could possibily be adapted for this duty fail to show or suggest the details of the present concepts as a combination; and a realistic consideration of the prior art's differences from the present concepts of the overall combination may more aptly be described as teaching away from the present invention's concepts, in contrast to suggesting them, even as to a hindsight attempt to perceive suggestions from a backward look into the prior art, especially since the prior art has long had much motivation as to details of the present invention and to its provisions.

And the existence of such prior art knowledge and related articles embodying such various features is not only conceded, it is emphasized; for as to the novelty here of the combination and of the invention as considered as a whole, a contrast to the prior art helps also to remind both the great variety of the various prior art articles and the needed attempts of improvement, and of the advantages and the inventive significance of the present concepts. Thus, as shown herein as a contrast to all the prior art, the inventive significance of the present concepts as a combination is emphasized and the nature of the concepts and their results can perhaps be easier understood.

Although varieties of prior art are conceded and ample motivation is shown and full capability in the prior art is conceded, no prior art shows or suggests details of the overall combination of the present invention as is the proper and accepted way of considering the inventiveness nature of the concepts.

That is, although the prior art may show an approach to the overall invention, it is determinatively significant that none of the prior art shows the novel and advantageous concepts in combination, which provides the merits of this invention, even though certain details are shown separately from this accomplishment as a combination.

And the prior art's lack of an invention of a coin display container achieving the convenience, attractiveness, simplicity of use and other advantages of the present invention, which are goals only approached by the prior art, must be recognized as showing a long-felt need.

Accordingly, the various concepts and components are conceded and emphasized to have been widely known in the prior art as to various devices; nevertheless, the prior art not having had the particular combination of concepts and details as here presented and shown in novel combination different from the prior art and its suggestions, with even only a fair amount of realistic humility to avoid consideration of this invention improperly by hindsight, requires the concepts and achievements here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art.

BRIEF DESCRIPTION OF THE DRAWINGS

The above description of the novel and advantageous invention is of somewhat introductory and generalized form. More particular details, concepts and features are set forth in the following and more detailed description of the preferred embodiment, taken in conjunction with the accompanying drawings which are of somewhat schematic and diagrammatic nature for showing the inventive concepts.

DETAILED DESCRIPTION OF THE PREFERRED EMBODIMENT

Figure 1:
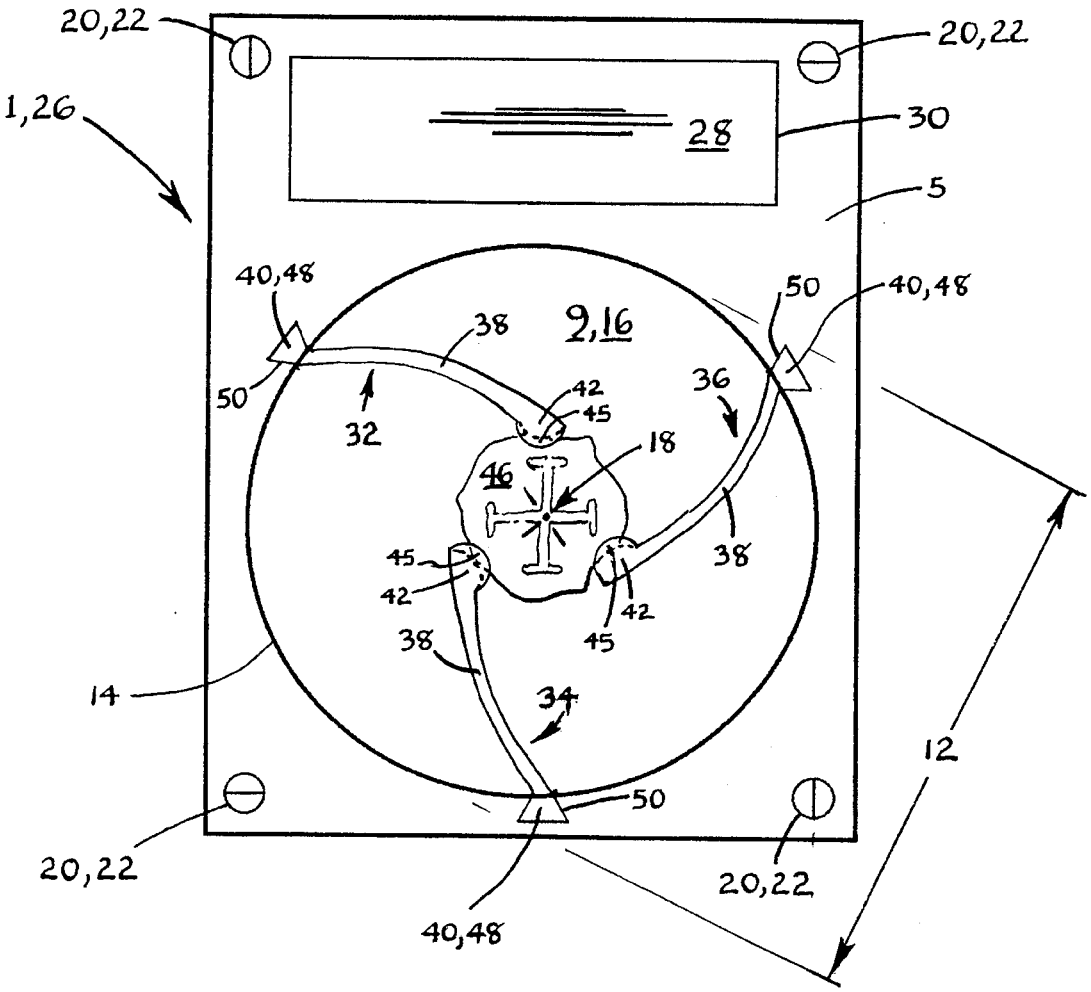
FIG. 1 is a top plan view of the present invention in its preferred embodiment, utilizing an inner frame piece, a pair of outer frame pieces, and removable transparent spring tension arms.

There are several embodiments of the invention which are here contemplated, one being the preferred embodiment and the others, alternate embodiments. In all embodiments, the invention provides a specialized interior cavity to fit a coin of any size and shape up to nearly the size limitations of the original cavity itself, particularly advantageous for irregularly shaped ancient coins; and in all examples, there is utilized a multiplicity of transparent spring tension arms, with grooves capable of clamping a coin and holding it substantially spatially centered within the cavity by means of multiple, but generally equally resolved spring tension forces. The grooves have smooth edges to prevent scratching the coin, even if it were made of relatively soft pure gold such as an 8 escudo Spanish treasure coin.

Of particular importance is that this invention, in all embodiments, will clamp a large or small coin in the same holder with no more effort than to place it in, or remove it, from the holder, and independent of the true roundness or uniformity of thickness of the coin.

The transparency of the plastic comprising the spring tension arms allows the coin to be fully viewed at its contact points with the arms, and allows the spring tension arms to be somewhat less visible between the clear outer faces, in contrast to the prior art opaque rubberlike inserts.

The preferred embodiment utilizes individual removable spring tension arms, for molding simplicity, whereas an alternate embodiment utilizes spring tension arms which are molded solidly to a removable ring unit.

Individual components of the present invention would preferrably be manufactured by the injection molded plastic process. Machining could be incorporated, but with slower, more expensive, and less precise results. Ease of molding via simpler and cheaper molding dies is the primary consideration for favoring the preferred embodiment with its individual components. Even though, with an alternate embodiment, the entire coin display holder could be as few as three parts, two coin case halves snap-locked together and a ring unit as described below, molding considerations may demand more numerous and simpler parts.

Also, the nuts and screws fastening arrangement, as described below, is preferred for security over a simple snap-lock arrangement for the coin case.

In the present state of the art of rubber and plastics manufacturing, pelletized clear polycarbonate plastic, to achieve maximum flexibility plus transparency, would be used to mold the spring tension arms. GE LEXAN® clear resin is an example of this type of product, General Electric Company, One Plastics Avenue, Pittsfield, Mass. 01201, (800) 845-0600. In contrast, in the case of prior art resilient rubberlike holed cores, it is impossible to combine flexibility plus transparency. The frame pieces would be molded of acrylic plastic for economy and hardness. Rohm and Haas Company PLEXIGLAS® Acrylic Molding Pellets are an example of this type of product, Rohm and Haas Company, Independence Mall West, Philadelphia, Pa. 19105, (800) 424-9300. The fasteners are vendor supplied plastic post nuts/screws.

Figure 2:
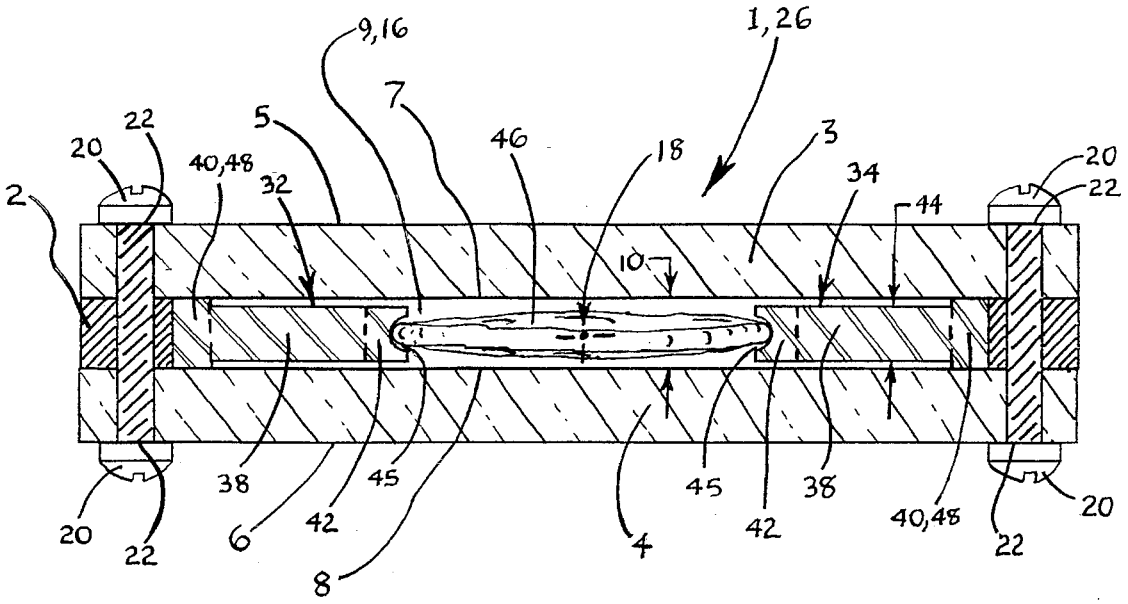
FIG. 2 is a conceptional cross-sectional side view of the present invention in its preferred embodiment, taken along a line bisecting the coin, two arms, and two fasteners, utilizing an inner frame piece, a pair of outer frame pieces, and removable transparent spring tension arms. For simplicity of showing, in FIG. 2, the removable label and its label basin, which are described in detail in the following text, are not shown.
Figure 3:
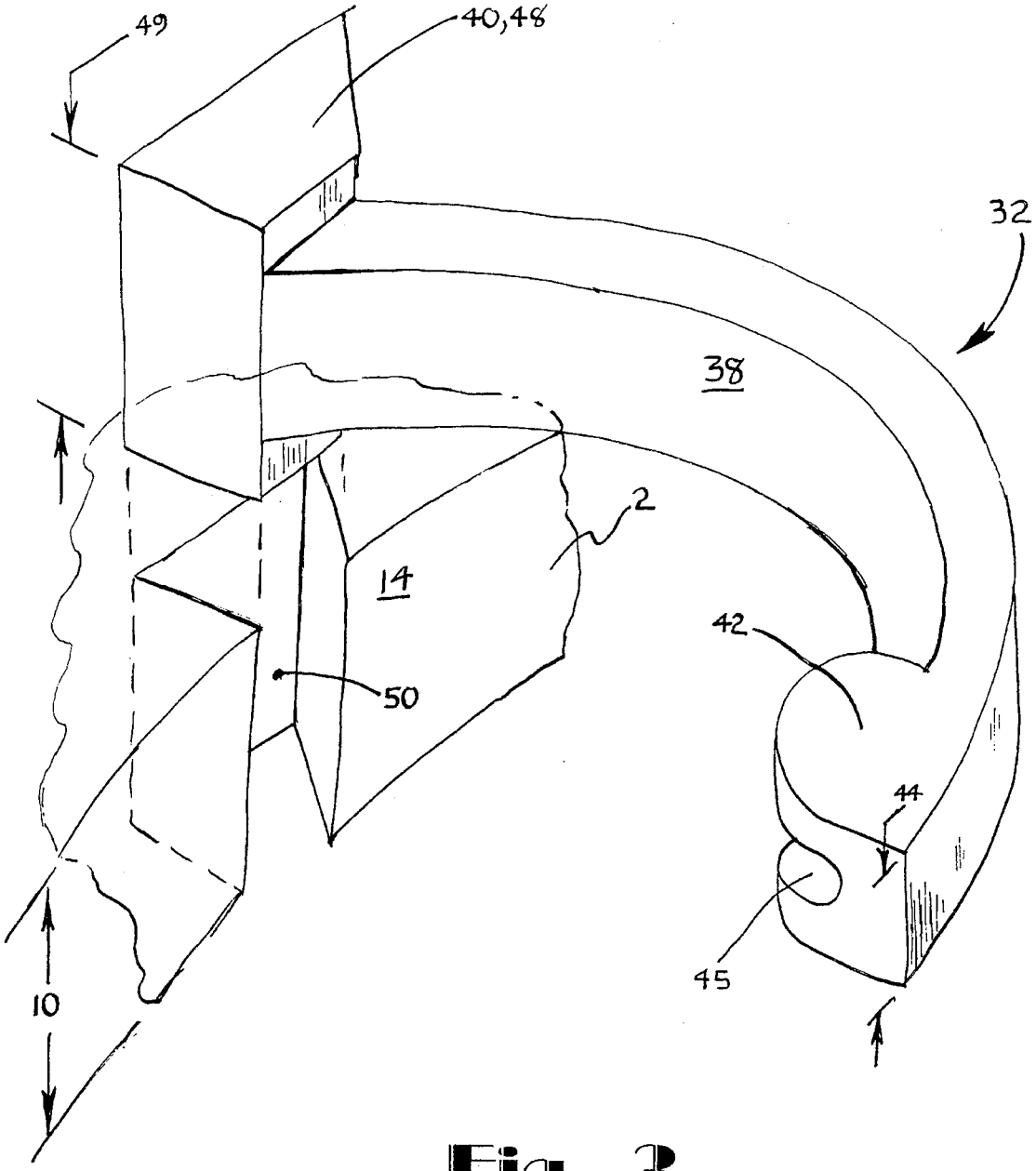
FIG. 3 is a perspective view of a removable transparent spring tension arm with a partial view of an inner frame piece.

As shown by the embodiments illustrated by the Drawings, the invention and its concepts advantageously provide a novel and useful coin case 1, FIGS. 1 & 2, which includes an inner frame piece 2 and a pair of outer frame pieces 3/4, these being formed of rigid plastic bodies of a substantially rectangular configuration, the two outer frame pieces 3/4 being transparent providing two opposing exterior see-through faces 5/6 for the purpose of coin visibility, whereas the inner frame piece 2 may desirably be colored. Outer frame pieces 3/4 include two inward see-through faces 7/8.

The inner frame piece 2 has a cavity 9 formed therein, with cavity 9 being defined by a cavity thickness 10, a cavity peripheral width 12 and a cavity peripheral side wall 14, providing the coin case 1 with an interior coin nesting void 16, void 16 having a central point 18.

A peripheral series of releasable holding means 20 is provided, and each of those releasable holding means 20 has force-applying means 22 which operatively engages both of the outer frame pieces 3/4 for drawing them toward one another to respectively press on the inner frame piece 2 outwardly of its cavity 9, for holding the inner frame piece 2 and the pair of outer frame pieces 3/4, when they are assembled into a coin enshrouding array 26, to be a face-juxtaposed layered assembly with the inner frame piece 2 sandwiched between the pair of outer frame pieces 3/4.

Figure 4:
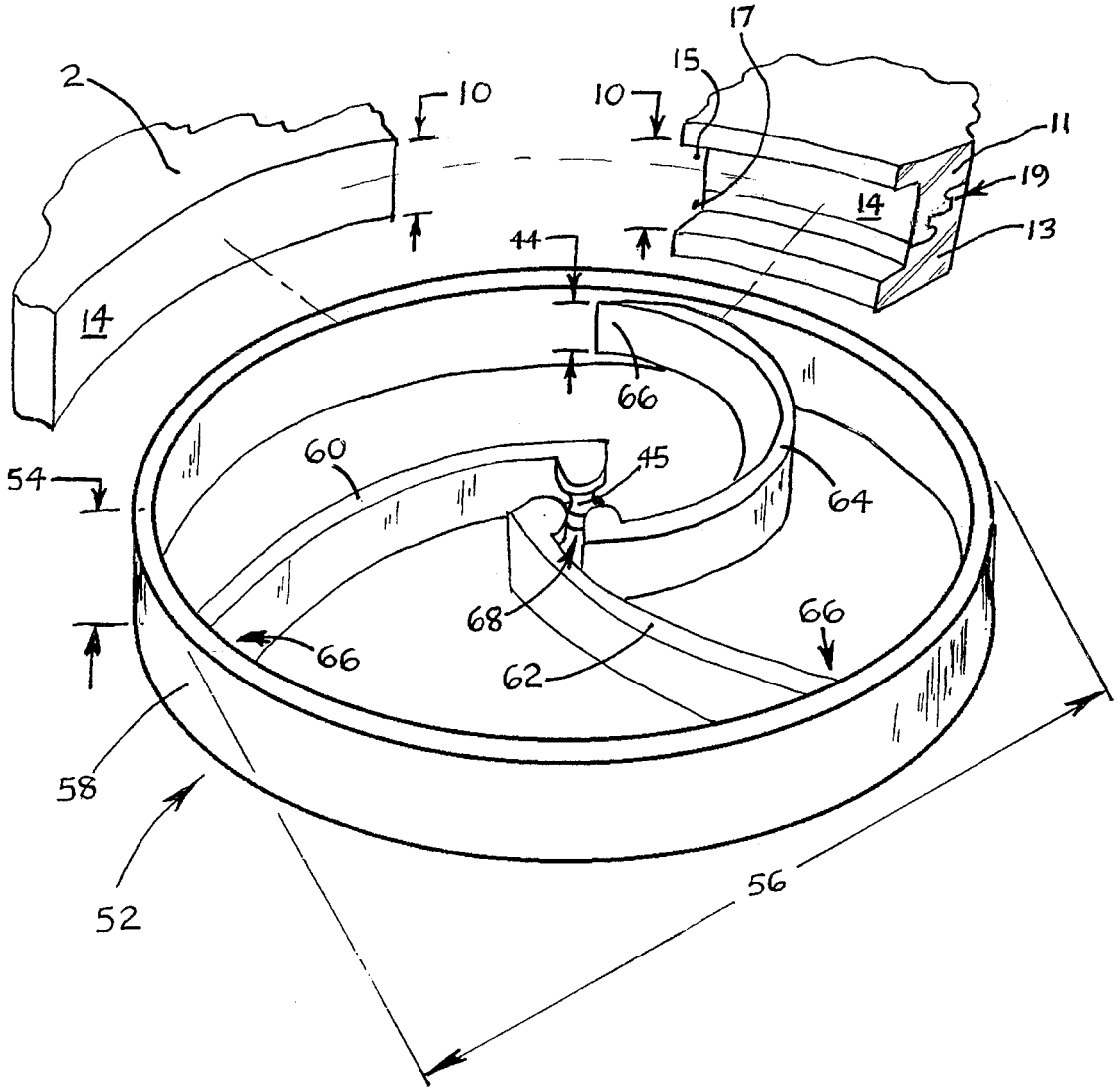
FIG. 4 is a perspective view of a transparent ring unit with a partial view of an inner frame piece, and a partial view of a pair of snap-locking outer frame pieces sans the inner frame piece.
Figure 1:
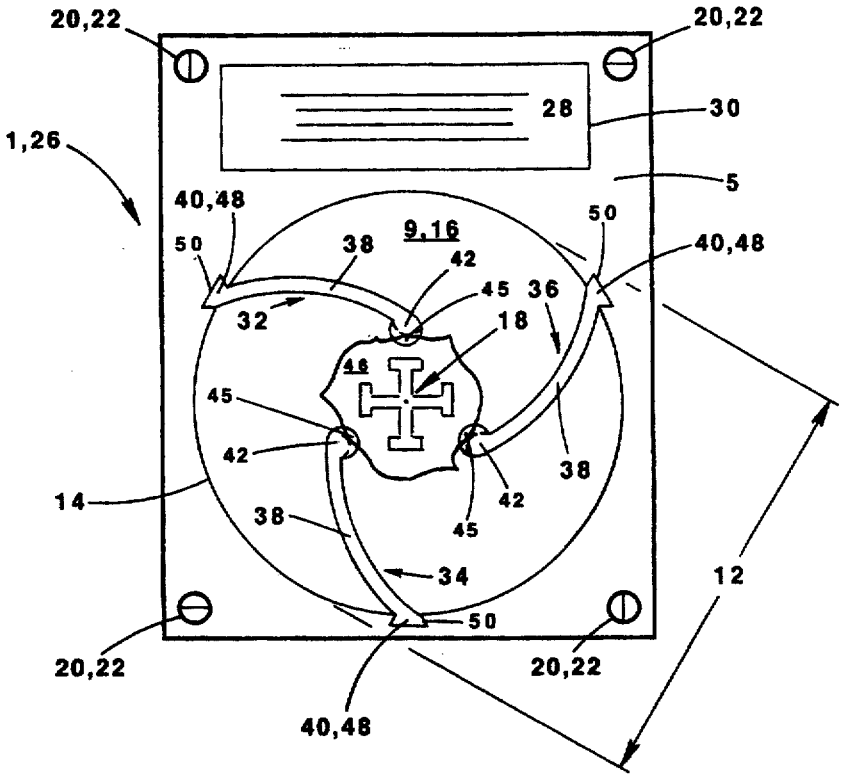
Figure 2:
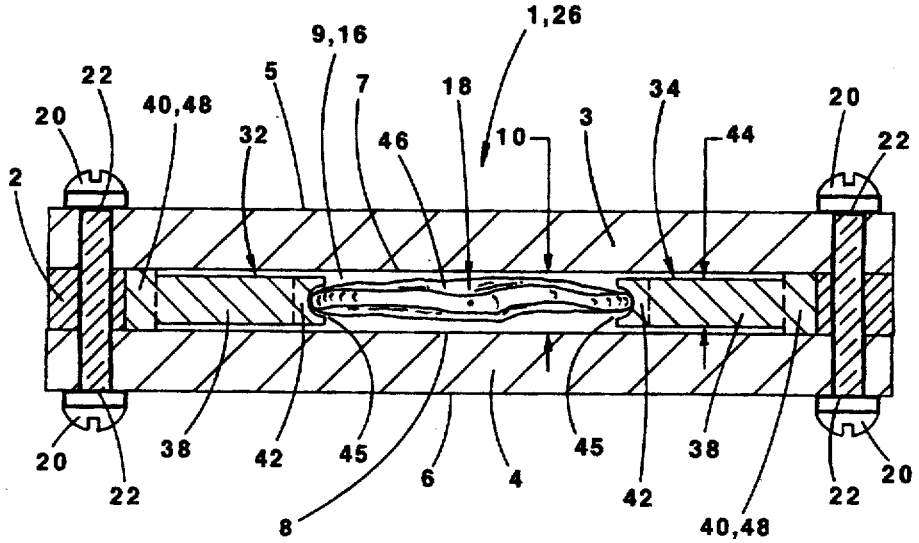
Figure 3:
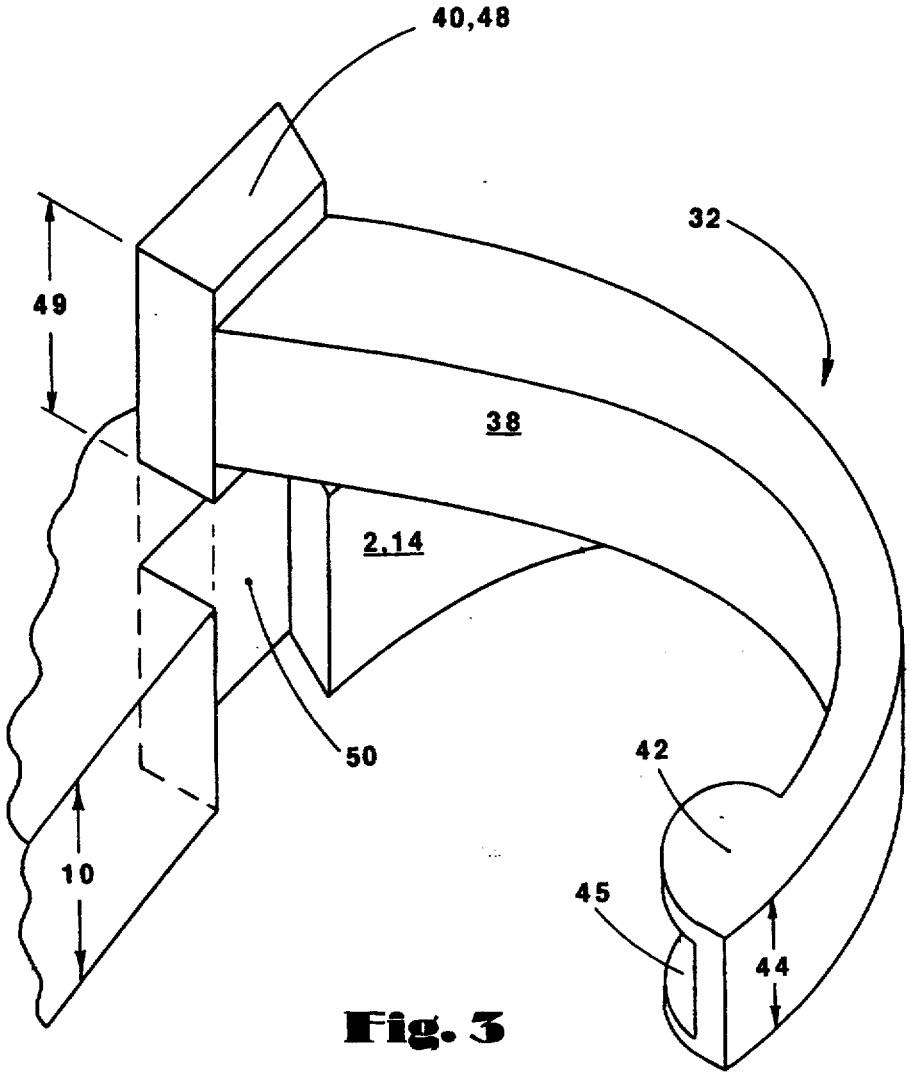
Figure 4:
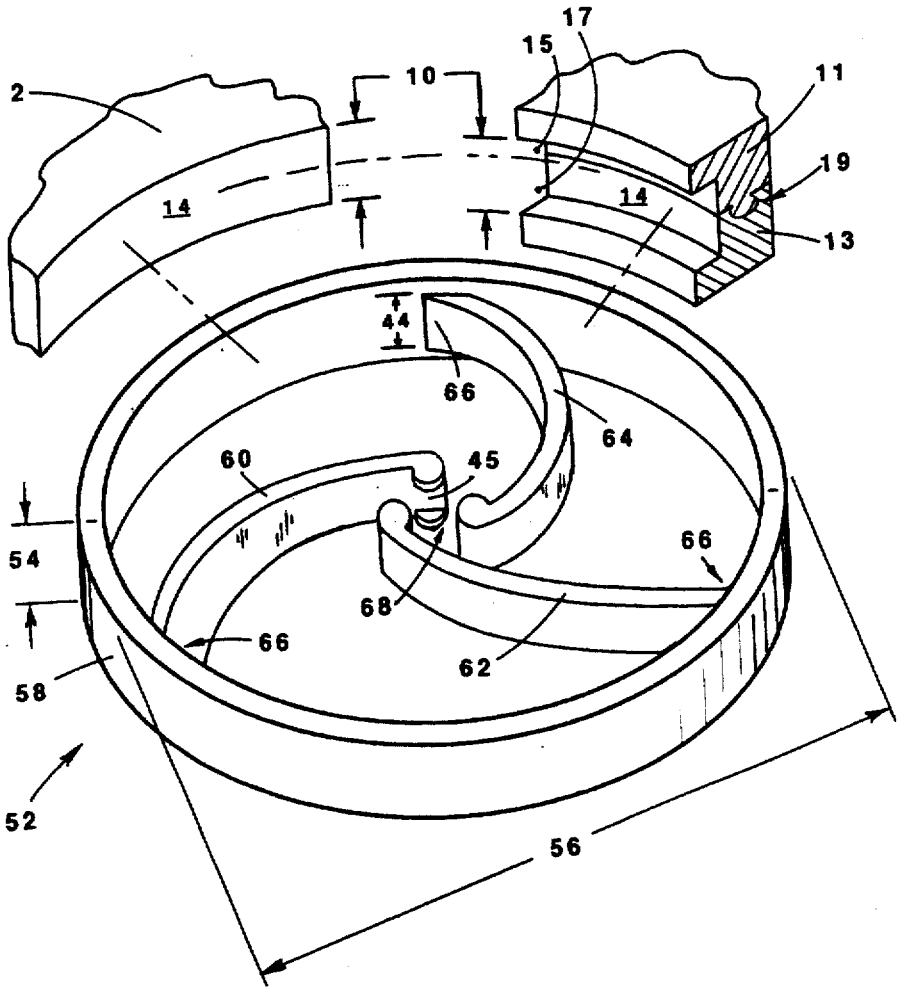

The coin enshrouding array 26 could, in an alternate embodiment, as shown in FIG. 4, be of a configuration comprising two outer frame pieces 11/13, sans an inner frame piece, with cavity halves 15/17 included therein, when drawn together with a force-applying means 19, form a pocket essentially the same as cavity 9, and interior coin nesting void 16.

Inner frame piece 2 includes a removable, substantially thin paper or plastic label 28, of a substantially rectangular configuration, to be documented as to the user's discretion. Label 28 is received within a substantially thin label basin 30, of a substantially rectangular configuration and confined by one of the inward see-through faces 7 when coin case 1 is assembled.

Coin case 1 includes two or more transparent spring tension arms 32/34/36, each shown as comprising an arm body 38, an outward end 40, an inward end 42 and an arm thickness 44. Transparent spring tension arms 32/34/36 are substantially conjoined to, but capable of being removable from coin case 1, arms 32/34/36 having a portion extending inward of coin case 1 into cavity 9. The portion of arms 32/34/36 which lies within cavity 9 has an arm thickness slightly less than cavity thickness 10 of interior coin nesting void 16 and having inward ends 42 resting close to central point 18 of coin nesting void 16.

Arms 32/34/36 are movable in an arc with outward ends 40 being substantially fixed to a wall 14, and inward ends 42 capable of moving within the coin nesting void 16. Arms 32/34/36 are in a relatively unstressed condition when the inward ends 42 are relatively close to the central point 18 of the coin nesting void 16. Arms 32/34/36 are in a relatively stressed condition when inward ends 42 are moved further outward away from central point 18 than when the arms 32/34/36 are in a relatively unstressed condition.

Inward ends 42 have grooves 45 aligning parallel with the two opposing exterior see-through faces 5/6. The grooves 45 allow the two or more transparent spring tension arms 32/34/36 to clamp a coin 46 when the spring tension arms 32/34/36 are in a relatively stressed condition.

The transparent spring tension arms 32/34/36 with their grooves 45 are capable of clamping the coin 46 and holding it substantially spatially centered with the coin nesting void 16 by means of multiple, but generally equally resolved spring tension forces. Three-dimensional centering of the coin 46 is accomplished by the contact points between the grooves 45 and the coin 46, holding it in position with respect to its general plane, and with respect to its position perpendicular to its general plane.

Transparent spring tension arms 32/34/36 have outward ends 40 substantially conjoined to the coin enshrouding array 26 by means of the outward ends 40 having tabs 48, shown as protuberances on outward ends 40 which are received within slots 50, shown as corresponding recesses for receiving tabs 48 therebetween, in the coin enshrouding array 26, and confined by the inward see-through faces 7/8 when coin case 1 is assembled. The tabs 48 and slots 50 are aligned perpendicularly with the two opposing exterior see-through faces 5/6. Tabs 48 have a tab thickness 49 substantially the same as cavity thickness 10. Cavity thickness 10 is correlative to the thickness of the slots.

In an alternate embodiment, as shown in FIG. 4, the coin case includes a transparent ring unit 52 having a ring thickness 54, a ring diameter or peripheral width 56 and ring outer side walls 58, with two or more transparent spring tension arms 60/62/64 having outward ends 66 solidly bonded to and conjoined to the transparent ring unit 52 and extending inward of the ring unit 52 toward the central point 68.

Transparent ring unit 52 is substantially conjoined to the coin enshrouding array 26 by means of the ring unit 52 being nested within cavity 9, ring unit 52 being confined in the interior coin nesting void 16 by the inward see-through faces 7/8 when the coin case is assembled, ring thickness 54 being substantially the same as cavity thickness 10, ring peripheral width 56 being substantially the same as cavity peripheral width 12 and cavity peripheral side walls 14 substantially abutting the ring outer side walls 58. The ring unit 52 is removable from the coin enshrouding array 26 by means of dismantling the coin case.

SUMMARY OF COMPONENTS AND OPERATIONAL DETAILS AND THEIR ADVANTAGES

The present invention as detailed herein has advantages in both concept and in component parts and features; for in contrast to other articles known to the inventor as to the prior art mentioned, the invention provides advantageous features which should be considered, both as to their individual benefit, and to whatever may be considered to be also their synergistic benefit toward the invention as a whole:

a. Allowability to view the entire coin without removing it from its holder;

b. Can be constructed of materials which will not chemically degrade the coin or physically mar the coin;

c. Ability to easily and quickly assemble and dissassemble the holder;

d. Attractive centering of the coin in the holder;

e. Maximum protection of the coin as by a hard case construction;

f. Protection against the coin slithering out of its holder;

g. Secureness of the coin in the holder no matter what the size or shape of the coin is, within nearly the limits of the casing's display area;

h. Secureness of the centered position of the coin in the holder no matter what the size or shape of the coin is, within nearly the limits of the casing's display area;

i. Only one size of holder need be provided no matter what the size or shape of the coin is, within the limits of the casing's display area;

j. The holder is an all-inclusive working unit without the need for a separated parts stash to be resorted to;

k. The holder could be as little as a three-piece unit;

l. In the case of coin dealers with numerous expensive coins and numerous customers, security is provided against customers removing the coin from its holder, fondling the coin, and possibly even covertly switching it with a replica;

m. Makes an advantageous display mount for ancient coins which are widely collected, yet whose characteristics make them the most difficult to attractively mount;

n. Advantages without contrasting disadvantages.

CONCLUSION

It is thus seen that a hard case coin display holder universal to coin size and shape, used according to the combination of inventive concepts and details herein set forth, provides novel concepts of a desirable and usefully advantageous article, yielding advantages which are and which provide special and particular advantages when used as herein set forth.

In summary as to the nature of the overall article's advantageous concepts, their novelty and inventive nature is shown by novel features of concept and construction shown here in advantageous combination and by the novel concepts hereof not only being different from all prior art known, even though other containers, various assemblies and multitudes of plastic and cardboard articles have been known and used for scores of years, but because the achievement is not what is or has been suggested to those of ordinary skill in the art, especially realistically considering this as a novel combination comprising components which individually are similar in nature to what is well known to most all persons, surely including most of the many makers and users of coin-encasing containers for a great number of years throughout the entire world. No prior art component or element has even suggested the modifications of any other prior art to achieve the particulars of the novel concepts of the overall combination here achieved, with the special advantages which the overall combination article provides; and this lack of suggestion by any prior art has been in spite of the long worldwide use of various types of containers for coin mounting and displaying.

The differences of concept and construction as specified herein yield advantages over the prior art; and the lack of this invention by the prior art, as a prior art combination, has been in spite of this invention's apparent simplicity of the construction once the concepts have been conceived, in spite of the advantages it would have given, and in spite of the availability of all of the materials to all persons of the entire world, and the invention's non-technical and openly-visible nature.

Quite certainly this particular combination of prior art details as here presented in this overall combination has not been suggested by the prior art, this achievement in its particular details and utility being a substantial and advantageous departure from prior art, even though the prior art has had similar components for numbers of years. And particularly is the overall difference from the prior art significant when the non-obviousness is viewed by a consideration of the subject matter of this overall device as a whole, as a combination integrally incorporating features different in their combination from the prior art, in contrast to merely separate details themselves, and further in view of the prior art of coin-mounting concepts and articles not achieving particular advantages here achieved by this combination.

Accordingly, it will thus be seen from the foregoing description of the invention according to the illustrative embodiments, considered with the accompanying drawings, that the present invention provides new and useful concepts of a novel and advantageous article, possessing and yielding desired advantages and characteristics in formation and use, and accomplishing the intended objects including those hereinbefore pointed out and others which are inherent in the invention.

Modifications and variations may be effected without departing from the scope of the novel concepts of the invention; accordingly, the invention is not limited to the specific embodiments, or form or arrangement of parts herein described or shown.

Thus, for example, the word "coin" is used in its broad and comprehensive sense, including ancient coins, medievel coins, and Spanish "cobs," including quartered or halved coins lobbed off to make change, fragments of coins which can be of a valuable historic nature, even if chipped or glued together, such as is illustrated by the price differential of a Julius Caesar silver denarius offered in the Classical Cash Mail Bid Sale Two illustrated catalog, item number 927 estimated at $300., while another similar Julius Caesar denarius in extra fine, but off-center condition, item number 925 is estimated at $1500. 6 Fayette Street, Boston, Mass. 02116, phone: (617) 350-0179, fax: (617) 482-6911. And including odd-shaped coins such as dolphin-shaped coins circulated as money in Olbia, 430-410 B.C., item number 173 in fine+ condition estimated at $60. in the same catalog. And including blanks which have managed to escape the hammering process altogether, and modern error coins such as off-center strikes, or even perfectly round modern coins, and any generally flat medal or medallion object which could be displayed in a hard case device, regardless of the nature of the non-symmetry or irregularity of the article, and regardless of the expensiveness or value-nature of the article, even though relatively expensive ancient coins would most likely be displayed in the present invention, leaving more common coins such as some 4th Century Roman coins of poor condition which cost as little as 75¢ each, to be still displayed in the plastic "flips."

What is claimed is:

1. A coin case comprised of:

a.) a dismantlable coin enshrouding array with a cavity which is accessible by dismantling said coin enshrouding array, b.) said cavity being defined by a cavity thickness, a cavity peripheral width and cavity peripheral side walls, providing said coin case with an interior coin nesting void, said void having a central point, c.) said coin enshrouding array being defined by a pair of outer frame pieces, these pieces being formed of rigid plastic bodies, said two outer frame pieces being transparent providing two opposing exterior see-through faces for the purpose of coin visibility, and two inward see-through faces, d.) said outer frame pieces provided with a peripheral series of releasable holding means, and each of the said releasable holding means having force-applying means which operatively engage both of said outer frame pieces for drawing them toward one another, when they are assembled into said coin enshrouding array, to be a face-juxtaposed layered assembly, e.) two or more transparent spring tension arms, each comprising an arm body having an outward end and an inward end and an arm thickness, said spring tension arms being substantially conjoined to said coin case, and said arms having a portion extending inward of said coin case into said cavity, f.) the portion of each of said spring tension arms which lies within said cavity having its said arm thickness slightly less than said cavity thickness of said interior coin nesting void and having its said inward end relatively close to said central point of said coin nesting void, g.) said arms being movable in an arc with said outward ends being substantially fixed and said inward ends capable of moving within said coin nesting void, h.) said arms being in a relatively unstressed condition when said inward ends are relatively close to said central point of said coin nesting void, i.) said arms being in a relatively stressed condition when said inward ends are moved further away from said central point than when said arms are in said relatively unstressed condition, j.) said inward ends having grooves aligned parallel with said two opposing exterior see-through faces, said grooves allowing said spring tension arms to clamp a coin when said spring tension arms are in said relatively stressed condition, and, k.) said spring tension arms with their said grooves being capable of clamping said coin and holding it substantially spatially centered with said coin nesting void by means of multiple, but generally equally resolved spring tension forces.

2. The coin case of claim 1 in a combination in which:

a.) said coin enshrouding array includes an inner frame piece in addition to said pair of outer frame pieces, b.) said pair of outer frame pieces are outwardly of said cavity, the said cavity being provided by, and formed within, said inner frame piece, and, c.) said peripheral series of releasable holding means, when operatively engaging both of the said outer frame pieces drawn toward one another, respectively press on said inner frame piece outwardly of its said cavity, for holding said inner frame piece and said pair of outer frame pieces, when they are assembled into said coin enshrouding array, to be said face-juxtaposed layered assembly with said inner frame piece sandwiched between the said pair of outer frame pieces.

3. The coin case of claim 1 in a combination in which:

a.) said spring tension arms are releasably, although substantially conjoined to, said coin case, b.) said spring tension arms have said outward ends substantially conjoined to said coin case by means of said outward ends having tabs provided as protuberances received within slots provided as corresponding recesses in said coin case for receiving said tabs therebetween, and, c.) said tabs are confined by said inward see-through faces when said coin case is assembled.

4. The coin case of claim 2 in a combination in which:

a.) said spring tension arms are releasably, although substantially conjoined to, said coin case, b.) said spring tension arms have said outward ends substantially conjoined to said coin case by means of said outward ends having tabs provided as protuberances received within slots provided as corresponding recesses in said coin case for receiving said tabs therebetween, and, c.) said tabs are confined by said inward see-through faces when said coin case is assembled.

5. The coin case of claim 1 in a combination in which:

a.) said coin enshrouding array includes a transparent ring unit defined by a ring thickness, a ring peripheral width, ring outer side walls, and a ring central point, b.) said spring tension arms have said outward ends solidly bonded to said ring unit and extend inwardly of said ring unit toward its central point, and, c.) said ring unit is substantially conjoined to said coin enshrouding array by means of said ring unit being nested within said cavity, said ring unit being confined in said interior coin nesting void by said outer frame pieces when said coin case is assembled.

6. The coin case of claim 2 in a combination in which:

a.) said coin enshrouding array includes a transparent ring unit defined by a ring thickness, a ring peripheral width, ring outer side walls, and a ring central point, b.) said spring tension arms have said outward ends solidly bonded to said ring unit and extend inwardly of said ring unit toward its central point, and, c.) said ring unit is substantially conjoined to said coin enshrouding array by means of said ring unit being nested within said cavity, said ring unit being confined in said interior coin nesting void by said outer frame pieces when said coin case is assembled.

* * * * *

UNITED STATES PATENT AND TRADEMARK OFFICE

CERTIFICATE OF CORRECTION

PATENT NO. : 5,590,761

DATED : January 7, 1997

INVENTOR(S) : David B. Owen

It is certified that error appears in the above-identified patent and that said Letters Patent is hereby corrected as shown below:

The Title page should be deleted and substitute therefor the attached title page.

Delete drawing sheets 1-4, and substitute therefor the drawing sheets, consisting of Figs. 1-4, as shown on the attached pages.

United States Patent [19]

Owen

[11] Patent Number: 5,590,761

[45] Date of Patent: Jan. 7, 1997

[54] COIN DISPLAY HOLDER

[76] Inventor: David B. Owen, 11513 River Dr. East, Carmel, Ind. 46033

[21] Appl. No.: 640,541

[22] Filed: May 2, 1996

[51] Int. Cl.[6] ..... A45C 11/24

[52] U.S. Cl. ..... 206/0.82; 206/776

[58] Field of Search ..... 206/0.8, 0.81, 206/0.82, 0.83, 0.84, 775, 776, 782

[56] References Cited

U.S. PATENT DOCUMENTS

| | | | |
|---|---|---|---|
| 3,028,949 | 4/1962 | Sohosky | 206/0.83 |
| 3,057,459 | 10/1962 | Burdick | 206/0.83 |
| 3,069,001 | 12/1962 | Burdick | 206/0.83 |
| 3,837,475 | 9/1974 | Bolanz | 206/0.8 |
| 4,402,399 | 9/1983 | Friess | 206/0.83 |

*Primary Examiner*—Jacob K. Ackun
*Attorney, Agent, or Firm*—Robert A. Spray, Patent Atty.

[57] ABSTRACT

A hard case coin display holder advantageously universal to coin size and shape, especially useful for ancient coins and Spanish pieces-of-eight which are always of irregular size and shape, while holding the coin attractively spatially centered, by at least two flexible transparent spring tension arms, within the protective confines of a quickly and easily assemblable and disassemblable see-through hard case. The present invention leaves much more of the irregularly shaped coin visible in the display than that achieved by opaque resilient rubberlike holed cores, which are the only present universal coin display interiors.

6 Claims, 4 Drawing Sheets

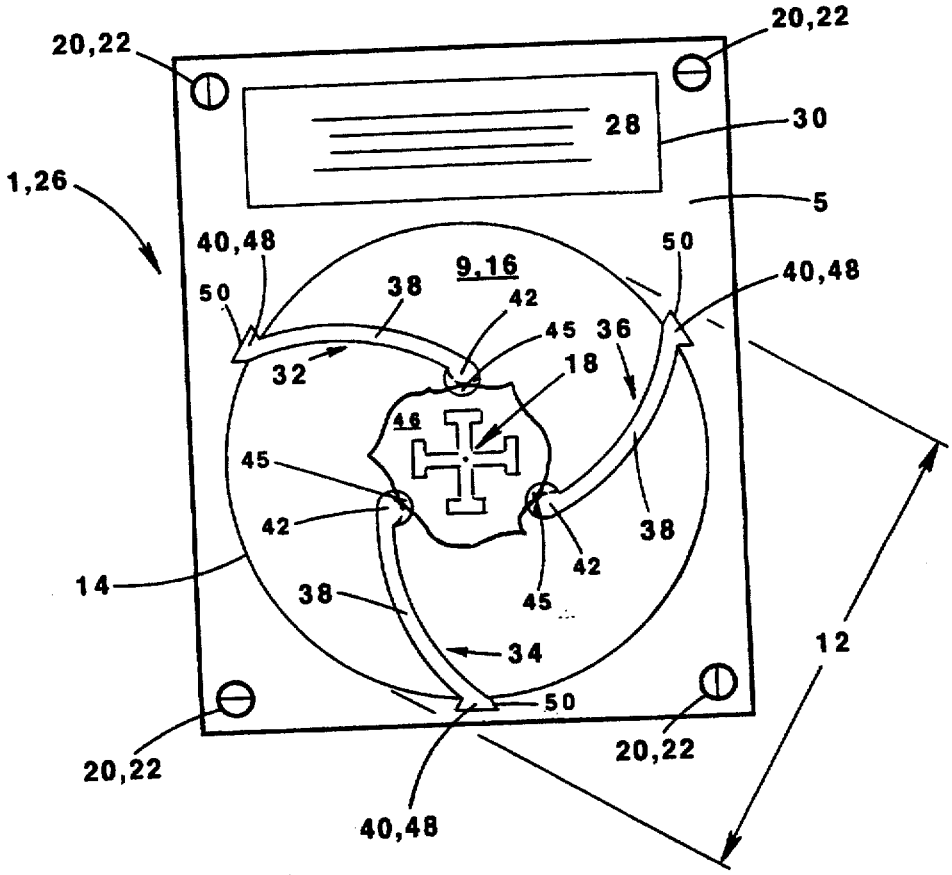

UNITED STATES PATENT AND TRADEMARK OFFICE

CERTIFICATE OF CORRECTION

PATENT NO. : 5,590,761

DATED : Jan. 7, 1997

INVENTOR(S) : David B. Owen

It is certified that error appears in the above-identified patent and that said Letters Patent is hereby corrected as shown below:

In the Specification:

Col. 2, line 66; change "prior" to "present".

Col. 5, line 20; "change "parent's" to "patent's".

Col. 5, line 44; change "INVENTION" to "INVENTION'S".

As to the Drawings:

Replace the original (informal) set of 4 Figs., 4 sheets with (formal) set of 4 Figs., 4 sheets.

Signed and Sealed this

Tenth Day of June, 1997

Bruce Lehman

*Attest:*

BRUCE LEHMAN

*Attesting Officer*

*Commissioner of Patents and Trademarks*